United States Patent [19]

Kawamura et al.

[11] Patent Number: 4,581,162

[45] Date of Patent: Apr. 8, 1986

[54] PROCESS FOR SOLIDIFYING RADIOACTIVE WASTE

[75] Inventors: Fumio Kawamura; Tetsuo Fukasawa; Naohito Uetake, all of Hitachi; Kiyomi Funabashi, Katsuta, all of Japan

[73] Assignee: Hitachi, Ltd., Tokyo, Japan

[21] Appl. No.: 473,864

[22] Filed: Mar. 10, 1983

[30] Foreign Application Priority Data

Mar. 12, 1982 [JP] Japan ..... 57-37961

[51] Int. Cl.[4] ..... G21F 9/16

[52] U.S. Cl. ..... 252/628; 106/74; 106/78; 252/633

[58] Field of Search ..... 252/631, 628, 633, 629, 252/626; 264/0.5; 106/74, 76, 77, 78, 84; 423/329, 326

[56] References Cited

U.S. PATENT DOCUMENTS

| | | | |
|---|---|---|---|
| 3,298,960 | 1/1967 | Pitzer | 252/628 |
| 3,959,172 | 5/1976 | Brownell et al. | 252/626 |
| 4,056,937 | 11/1977 | Suzuki | 106/74 |
| 4,058,479 | 11/1977 | White et al. | 252/633 |
| 4,122,028 | 10/1978 | Iffland et al. | 252/628 |
| 4,222,889 | 9/1980 | Verpmann | 252/633 |
| 4,226,556 | 10/1980 | Kayahara | 106/74 |
| 4,229,316 | 10/1980 | Baatz et al. | 252/633 |
| 4,319,926 | 3/1982 | Nowakowski et al. | 106/74 |
| 4,452,635 | 6/1984 | Noshi et al. | 106/74 |

*Primary Examiner*—Stephen L. Lechert, Jr.
*Assistant Examiner*—Howard J. Locker
*Attorney, Agent, or Firm*—Antonelli, Terry & Wands

[57] ABSTRACT

A solid radioactive waste can be solidified by a process comprising packing a solid radioactive waste in a container, adding to the container an aqueous solution comprising an alkali silicate, a hardening agent and a fluidity-improving agent for the aqueous solution and conducting the solidification of the alkali silicate, the resulting solidified radioactive waste being excellent in weather resistance, showing no cracks and having sufficient strength.

11 Claims, 5 Drawing Figures

PROCESS FOR SOLIDIFYING RADIOACTIVE WASTE

This invention relates to a process for treating radioactive wastes generated in atomic power plants, etc. More particularly, it relates to a process for solidifying radioactive waste pellets by use of water glass as a filler.

Reduction of volume and stable solidifcation into containers such as drum and the like of various radioactive wastes generated in an atomic power plant, etc. are not only important for maximum utilization of a storage space in the plant site, but also indispensable from a safety standpoint as well as from the standpoint of on-land storage and disposal as one of the ultimate disposals.

As one process for reducing the volume of radioactive wastes, there has been investigated, for example, a process for reducing the volume of wastes substantially by (a) drying and pulverizing a concentrated liquid waste (containing $Na_2SO_4$ as the major component) and a slurry of spent ion exchange resin (both being major wastes generated in a BWR plant) in a dryer and then (b) pelletizing the resulting powder by use of a pelletizer such as briquetting machine. It has been confirmed that, according to this process, the volume of the liquid waste and the slurry can be reduced to about one-eighth of the volume obtained in the conventional process of direct solidification of the liquid waste and the slurry by cement, i.e. the process of solidification by cement. However, this process still has a drawback in that waste pellets can not be converted to a stable solidification product if a hydraulic cement or the like is used as a filler. This problem is due to the fact that, since cement is used in its mixture with water, dry pellets absorb the water and thereby these pellets cause swelling and dissolution. Hence, there have been investigated processes for solidification by use of a filler using no water, for example, asphalt, plastic or the like. These processes, however, still have such disadvantages that operation must be carried out at a high temperature and the fillers themselves are extremely expensive.

Thus, a process for solidification of radio-active waste pellets by a filler (solidifying agent) with easy operation, a low cost and an excellent stability during long term storage has been desired.

This invention provides a process for solidifying radioactive wastes by use of so-called water glass as a filler, which satisfies the above desires and is excellent in weather resistance, operability and economy.

In accordance with this invention, there is provided a process for solidying a radioactive waste which comprises packing a solid radioactive waste in a container, adding to the container an aqueous solution comprising an alkali silicate as a filler, a hardening agent for said alkali silicate, and a fluidity-improving agent for the aqueous solution, and conducting the solidification of the alkali silicate to give a solidified radioactive waste.

In the accompanying drawings, FIG. 1 is a drawing illustrating one embodiment of the process of this invention.

Figure 1:
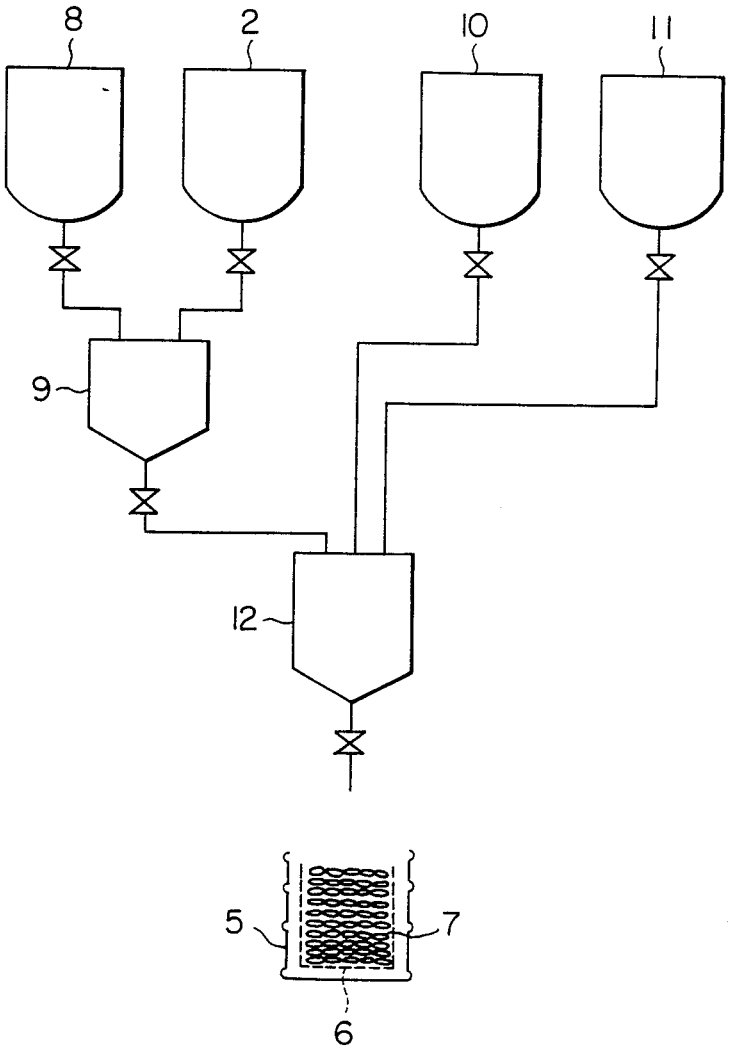

The container usable in the process of the present invention may be any of a number of different container so long as it has an appropriate shape and strength applicable in solidification of solid radioactive wastes. Practically, drums are used. When a solid radioactive waste is in the form of pellets, it is preferable to use a drum equipped with a basket capable of holding the pellets (numeral 6 in FIG. 1) with a constant distance from the inner walls of the drum.

The solid radioactive waste can be obtained, for example, by drying and pulverizing a radioactive waste (major component: $Na_2SO_4$) generated in an atomic power plant, etc. by a conventional method, or by drying and pulverizing a slurry of spent ion exchange resin by a dryer such as centrifugal thin film dryer or the like. A preferred form of the solid radioactive waste is pellets obtained by pelletizing the pulverized radioactive waste by use of a usual pelletizer such as, for example, briquetting machine, tableting machine or the like.

The alkali silicate used as a filler may be used in a solid form or in a liquid form. When it is used in a liquid form, it is so-called water glass. When the alkali of the alkali silicate is, for example, sodium, the silicate is represented by $Na_2O.nSiO_2.xH_2O$. When water content is low in this sodium silicate, its fluidity is insufficient, whereby it is difficult to pour the silicate into drums. Hitherto, the water content of 50 to 60% by weight has been required in order to obtain a minimum viscosity of $10^3$ cp necessary for pouring a silicate solution into drums. However, in this invention, with the help of a special fluidity-improving agent (hereinunder referred to as "fluidizing agent"), the water content of the silicate solution can be lowered to, needless to say 40% by weight or less, 20% by weight or less assuring fluidity of the solution and its pouring into drums. Moreover, as a result of water reduction in the silicate solution, addition of an water absorbent which seems to be necessary inherently becomes unnecessary. Furthermore, in this invention, there can be used, if desired, an alkali silicate powder recently put into market (obtained by vaporizing water from a conventional alkali silicate) in place of an aqueous alkali silicate solution conventionally used. This provides an operational advantage in handling compared with the case using a solution type silicate.

As the hardening agent for the alkali silicate, there may be used phosphates such as $NaPO_3$, $Na_2HPO_4$, $MO_{m/2}.nP_2O_5$ (wherein M represents a metal including silicon, m the valency of the metal M, and n the number of 0.1 to 0.7) and the like; calcium carbonate; H (hydrogen) type zeolites; alkaline earth metal type zeolites; strong acids such as $H_2SO_4$, HCl, $HNO_3$ and the like. In view of homogeneity after hardening, phosphate powders, calcium carbonate and the above zeolites are preferable. Inorganic phosphate compounds represented by the formula $MO_{m/2}.nP_2O_5$ and calcium carbonate are more preferable.

As the fluidizing agent, naphthalenesulfonic acid-formaldehyde high condensates and salts thereof are preferable. Here, the naphthalenesulfonic acid-formaldehyde high condensate means a mixture containing 8% by weight or less of unreacted naphthalenesulfonic acid and 70% by weight or more of naphthalenesulfonic acid-formaldehyde condensate having 5 or more naphthalene rings, and the salt thereof means an alkali metal (Na, K, Li, etc.) salt or alkaline earth metal (Ca, Mg etc.) salt of such a high condensate. These salts of naphthalenesulfonic acid-formaldehyde high condensates are known as dispersant for cement particles or as water-reducing agent for cement (Japanese Patent No. 485,391, German Patent No. 1,238,831, Japanese Patent Application Kokoku (Post-Exam Publn) No. 9564/1973). However, this action in cement as dispersant or as water-reducing agent which improves dispersibility and provides cement particles with sufficient fluidity at a lower water content is not required at all in water glass, because water glass does not contain particles such as cement and by itself is an aqueous solution of good fluidity. The reason why naphthalenesulfonic acid-formaldehyde high condensates act as a fluidizing agent in water glass is not clarified yet, however, it is presumed that these high condensates act to form a uniform water film on the alkali silicate powder as well as on the hardening agent to improve dispersibility and fluidity by a capillary electric phenomenon.

Figure 3:
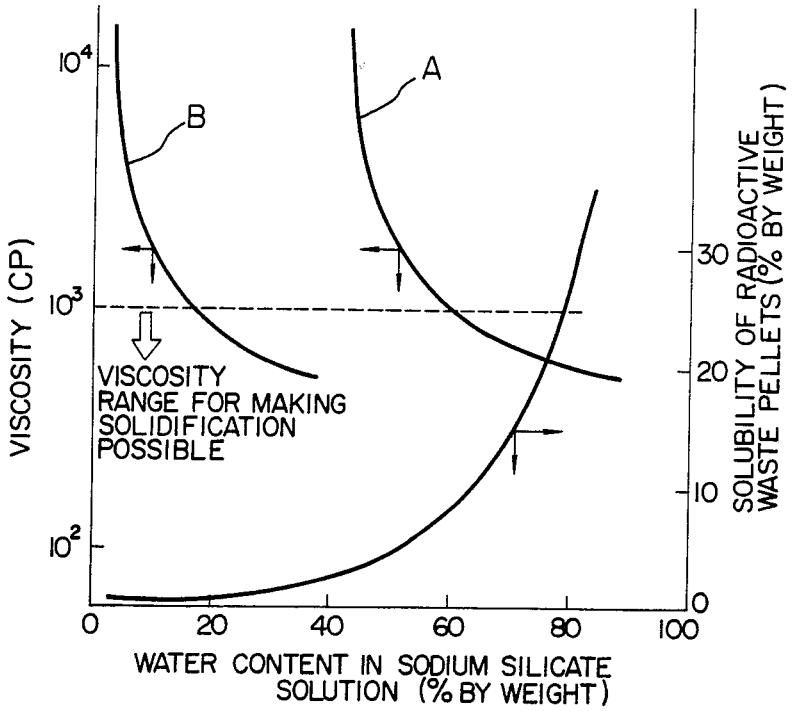
FIG. 3 is a graph showing a relation between water content in sodium silicate solution and viscosity of the solution as well as a relation between the water content and solubility of radioactive waste pellets.

FIG. 3 is a graph showing a relation between the water content in sodium silicate solution and viscosity of the solution as well as a relation between the water content and solubility of radioactive waste pellets. In the curve A in FIG. 3 where no fluidizing agent is added, the viscosity of $10^3$ cp or less which is necessary for solidification operation can be attained by a water content of 60% by weight or more and a solubility of radioactive waste pellets at such a water content is high. In order to make the solubility of pellets lower, addition of an appropriate water absorbent becomes necessary. On the other hand, in the curve B in FIG. 3 where a fluidizing agent according to the present invention is used in a quantity of 1.0% by weight, a sufficient fluidity is assured at a water content of about 20% by weight and the solubility of pellets at this water content is extremely as low as 1 to 2% by weight or lower. Hence, the addition of water absorbent is unnecessary in this invention.

The aqueous solution for solidification can be prepared, for example, as shown in FIG. 1. That is, an alkali silicate powder is placed in a tank 8 and a hardening agent, for example, a phosphate powder is placed in a tank 2. They are mixed in a mixer 9. This mixture is further mixed in a tank 12, with water from a tank 10 and a fluidizing agent from a tank 11, to obtain an aqueous alkali silicate solution having a desired viscosity as solidifying agent.

The above mixing method is one example of obtaining an aqueous alkali silicate solution as solidifying agent. The solution may be prepared also by an ordinary mixing method.

The preferable composition of the aqueous alkali silicate solution as solidifying agent is 25 to 65% by weight of an alkali silicate (as solid), 3 to 50% by weight of a hardening agent, 10 to 25% by weight of water and 0.6 to 2.4% by weight, more preferably 0.8 to 2.0% by weight of a fluidizing agent.

A solid radioactive waste can be solidified by adding thereto the aqueous alkali silicate solution as solidifying agent obtained above, followed by standing for a sufficient time. In this case, it is preferable that, after voids among radioactive waste pellets have been filled with the aqueous alkali silicate solution, deaeration be conducted under reduced pressure so that no air bubbles are left. The solidification can be attained by allowing to stand at room temperature and a special operation such as heating is not particularly required.

Figure 2:
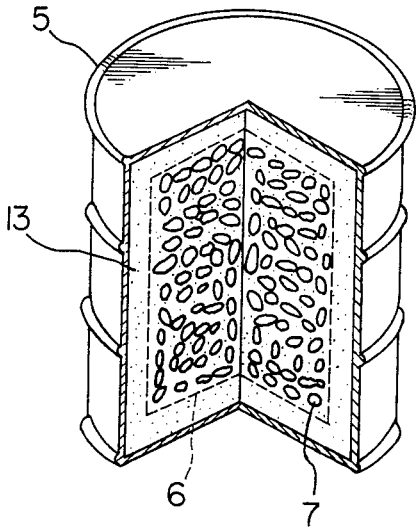
FIG. 2 is a partially cross-sectional perspective view illustrating one example of solidified radio-active wastes obtained by the process shown in FIG. 1.

The solidified radioactive waste thus obtained has a form of, for example, FIG. 2. In FIG. 2, numeral 5 is a drum, 6 a basket, 7 radioactive waste pellets and 13 a solidified product obtained.

The solidified product thus formed shows no cracks caused by water absorption and swelling, is sufficient in strength, and is excellent in weather resistance, operability (because a water absorbent for removing surplus water is not used) and economy (because an expensive filler, etc. are not used).

As mentioned above, in this invention, radio-active waste solids especially pellets can be easily solidified by (a) adopting a solidification method by alkali silicate and (b) making the water content low and yet maintaining a necessary viscosity by the help of a fluidizing agent. Consequently, the process of this invention has highly meritorious effects in economy, weather resistance and handling.

EXAMPLE 1

A case of solidifying an radioactive waste in a drum of 200 liters used in a conventional solidification of radioactive wastes is illustrated in accordance with FIG. 1.

Firstly, in a basket 6 placed inside of a drum 5 of 200 liters, there was charged about 250 kg of radioactive waste pellets 7 containing $Na_2SO_4$ as the major component. Then in a mixer 9, there were mixed a sodium silicate powder from a tank 8 composed of 40% by weight of $Na_2O$ and 60% by weight of $SiO_2$ and a hardening agent from a tank 2 which is a slow release type inorganic phosphate compound represented by $SiO_2.nP_2O_5$. Subsequently, in a mixer 12, there were mixed this powder mixture, water from a tank 10 and a fluidizing agent from a tank 11 which is a sodium salt of a naphthalenesulfonic acidformaldehyde high condensate. The mixing ratio was 1 (sodium silicate): 1 (hardening agent): 0.4 (water): 0.02 (fluidizing agent). The solidifying agent thus obtained was poured into the 200-liters drum 5 to fill voids among the radioactive waste pellets 7. Deaeration under reduced pressure was applied to remove remaining air bubbles and then the content inside the drum was allowed to stand at room temperature to be solidified. The solidification was complete in several hours. Thus, a solidified product 13 of the radioactive waste as shown in FIG. 2 was obtained.

The solidified product thus obtained showed no cracks caused by water absorption and swelling of pellets, was sufficient in strength and had excellent weather resistance.

In this example, the radioactive waste pellets were charged into the drum 5 in advance. The same effect as in Example 1 can also be obtained by mixing radioactive waste pellets, sodium silicate, water and a hardening agent and then charging the mixture into a drum.

In the above example, the case using radio-active waste pellets containing $Na_2SO_4$ as the major component was explained. It has been confirmed that the same effect can be obtained also for a case using pellets of a spent ion exchange resin, etc.

REFERENCE EXAMPLE 1

Measurement of Effects of Fluidizing Agents

Effects of various compounds as fluidizing agent were examined. Results are shown in FIG. 4.

As fluidizing agents, there were used a salt of naphthalenesulfonic acid-formaldehyde high condensate (curve C), a polyol composition (curve D), a salt of gluconic acid (curve E), a salt of lignin sulfonic acid (curve F) and a polyoxyethylene alkylaryl ether (curve G). With a fluidizing agent, a mixture comprising 62.5% by weight of a 60% by weight sodium silicate solution, 25% by weight of a hardening agent of an inorganic phosphate compound and 12.5% by weight of portland cement was mixed, while the amount of each of the above-mentioned fluidizing agents was changed. Viscosities of the sol mixtures obtained were measured.

Figure 4:
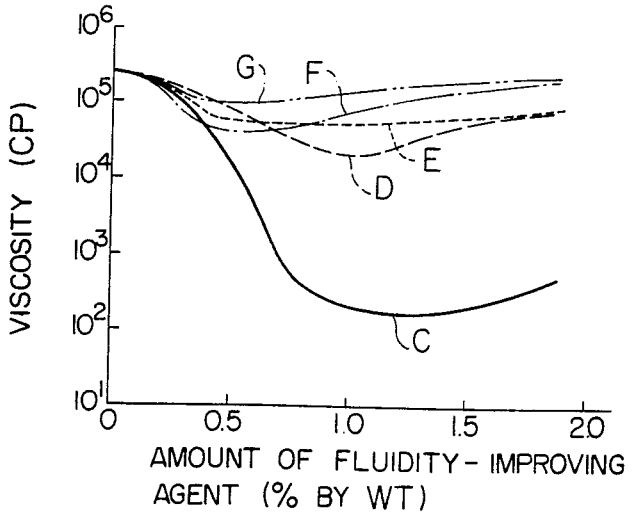
FIG. 4 is a graph showing a relation between the addition amount of fluidity-improving agent in sodium silicate solution and viscosity of the solution.

It is clear from FIG. 4 that fluidizing agents other than the salt of naphthalenesulfonic acid-formaldehyde high condensate were ineffective. As the salt of naphthalenesulfonic acid-formaldehyde high condensate, there was used a compound represented by the following formula:

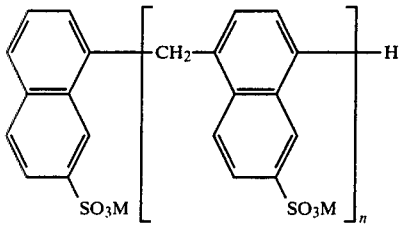

wherein M is an alkali metal (e.g. Na, K or Li) or an alkaline earth metal (e.g. Ca or Mg). The compound contained 70% by weight or more of the salt of high condensates having n of 5 or more and 8% or less of unreacted salt of naphthalenesulfonic acid having n of 0. It was found from FIG. 4 that the addition of about 1.0% by weight of the salt of naphthalenesulfonic acid-formaldehyde high condensate reduced the viscosity of the sol mixture to about 1/1000.

REFERENCE EXAMPLE 2

Effect of Amount of Fluidizing Agent

The sol mixtures used in Reference Example 1 containing the salt of naphthalenesulfonic acid-formaldehyde high condensate as fluidizing agent in various quantities were tested for change of viscosity with time. Results were shown in FIG. 5.

Figure 5:
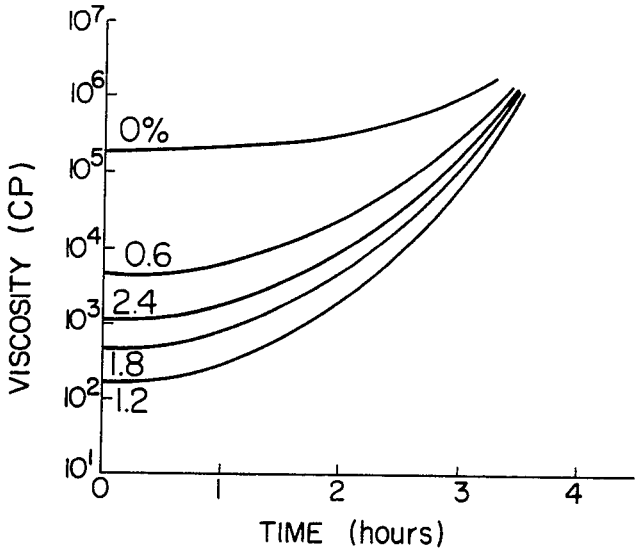
FIG. 5 is a graph showing viscosity changes with time of sodium silicate solutions to which a fluidity-improving agent is added in various amounts.

As is clear from FIG. 5, irrespective of the added amount of the salt of naphthalenesulfonic acid-formaldehyde high condensate, tendencies of viscosity changes with the lapse of time and curing times were almost the same, and the fluidizing agent did not deteriorate properties of these solidifying agents. Also, strength and other mechanical properties of solidified products obtained were almost constant, irrespective of the added amount of the fluidizing agent.

As is clear from FIGS. 4 and 5, it is preferable that said fluidizing agent is added to the sodium silicate solidifying agent (containing the hardening agent, etc.) in a quantity of 0.6 to 2.4% by weight. When the fluidizing agent is within this range, even if the water content in the solidifying agent is 25% by weight, solidification operation is sufficiently assured. When the fluidizing agent is added in a quantity of 0.8 to 2.0% by weight, solidification operation is assured even if the water content is 20%. Since solidification operation in a lesser water content removes undesirable consequences caused by surplus water, addition of the fluidizing agent in a quantity of 0.8 to 2.0% by weight is more preferable.

What is claimed is:

1. A process for solidifying a radioactive waste which comprises packing a plurality of solid radioactive waste pellets in a container, adding to the container an aqueous solution comprising an alkali silicate as a filler, a hardening agent for the alkali silicate, and a fluidity-improving agent for the aqueous solution and less than 50% by weight of water, and effecting solidification of the alkali silicate to give a solidified radioactive waste; said fluidity-improving agent being a naphthalenesulfonic acid-formaldehyde high condensate or a salt thereof.

2. A process according to claim 1, wherein the hardening agent is an inorganic phosphate compound.

3. A process according to claim 1, wherein the salt of naphthalenesulfonic acid-formaldehyde high condensate is an alkali metal salt or alkaline earth metal salt thereof.

4. A process according to claim 3, wherein the salt of naphthalene-sulfonic acid-formaldehyde high condensate is an alkali metal salt or an alkaline earth metal salt of a mixture containing 8% by weight or less of unreacted naphthalenesulfonic acid salt, and 70% by weight or more of naphthalenesulfonic acid-formaldehyde high condensate salt having 5 or more naphthalene rings.

5. A process according to claim 1, wherein the container is a drum containing therein a basket with a constant distance from the inner walls of the container.

6. A process according to claim 1, wherein the aqueous solution is obtained by mixing an alkali silicate powder and a hardening agent powder, followed by addition of the water and the fluidity-improving agent.

7. A process according to claim 1, wherein the aqueous solution contains 25 to 65%, by weight of the alkali silicate, 3 to 50% by weight of the hardening agent, 10 to 25% by weight of water, and 0.6 to 2.4% by weight of the fluidity-improving agent.

8. A process according to claim 1, wherein the salt of naphthalenesulfonic acid-formaldehyde high condensate is represented by the formula:

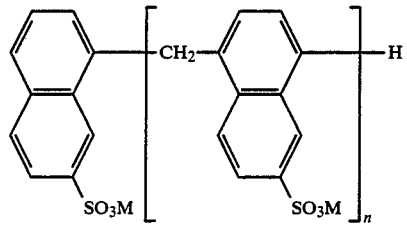

wherein M is Na, K, Li, Ca or Mg; and n is an integer of 5 or more.

9. A process according to claim 1, wherein said aqueous solution contains not more than 40% by weight of water.

10. A process according to claim 1, wherein said aqueous solution is free of a water absorbent.

11. A process according to claim 7, wherein said hardening agent is an inorganic phosphate compound, calcium carbonate, a hydrogen-type zeolite, or a strong inorganic acid.

* * * * *